United States Patent [19]

Liou

[11] Patent Number: 4,970,810

[45] Date of Patent: Nov. 20, 1990

[54] ELECTRONIC FLOWER SET WITH INTERMITTENT MOVEMENT

[76] Inventor: Ming T. Liou, 52, Hsin Tsuo, 7 Lin, Hsin Li, Cho Lan Chen, Miao Li Hsien, Taiwan

[21] Appl. No.: 375,198

[22] Filed: Jul. 3, 1989

[51] Int. Cl.[5] ..... G09F 19/08

[52] U.S. Cl. ..... 40/414; 40/411; 446/175; 272/8 N; 428/24

[58] Field of Search ..... 40/411, 414, 417–421, 40/423, 429, 431, 614; 446/175; 272/8 N; 428/12, 24, 25, 26

[56] References Cited

U.S. PATENT DOCUMENTS

| | | | |
|---|---|---|---|
| 1,964,477 | 6/1934 | O'Brien | 40/419 |
| 3,250,533 | 5/1966 | Nicholson II | 40/419 |
| 3,367,051 | 2/1968 | Tylle | 40/416 |
| 4,903,424 | 2/1990 | Satoh et al. | 40/414 |

FOREIGN PATENT DOCUMENTS

| | | | |
|---|---|---|---|
| 943795 | 3/1949 | France | 40/411 |

*Primary Examiner*—Kenneth J. Dorner
*Assistant Examiner*—J. Hakomaki
*Attorney, Agent, or Firm*—Connolly and Hutz

[57] ABSTRACT

An electronic flower set including a flower set, a housing, an inner seat, a inner cover, a gear assembly, a matching plug, a first pinion, and a second pinion. The flower set has a rotatable stem. The gear assembly includes a third gear which has a circular recess and two matching holes. The third gear is formed with a stopper at a surface. The matching plug is retained in the circular recess and has a tube which is received by the central hole of the third gear and two matching holes. The first pinion has an end tube adaptable to be fixed in one of the matching holes, a sideward extending arm, and a hexagonal-shaped end tube which can be fixed in a hexagonal-shaped cavity of a head of the rotatable stem. The second pinion, which is meshed with the first pinion, includes an end tube fixable in the remaining matching holes of the matching plug, a sideward extending arm, and a round-shaped end tube which is retainable in an retaining cavity of the inner cover.

10 Claims, 4 Drawing Sheets

ELECTRONIC FLOWER SET WITH INTERMITTENT MOVEMENT

BACKGROUND OF THE INVENTION

The present invention relates to an electronic flower set having a sound control structure which is motor-driven and actuated by microphone through a circuit board having mechanical transducer such that the electronic flower set moves intermittently.

Heretofore, various types of sound control electronic toys have been available in the market. Such conventional sound control toy structures employ microphones to receive external sound signals and transmit the same through electronic circuits to actuate a motor or motors, and to further actuate the toy structures by gear assemblies through the axles of the motors. However, the above-mentioned toy structures are limited to toy vehicles or some other mechanical toys. There is a lack of ornamental toys having movement.

SUMMARY OF THE INVENTION

It is therefore a primary object of the present invention to provide an electronic flower set which moves intermittently.

It is a further object of the present invention to provide an electronic flower set which includes a gear assembly capable of actuating the flower set to move intermittently.

DETAILED DESCRIPTION OF THE PREFERRED EMBODIMENT

Figure 1:
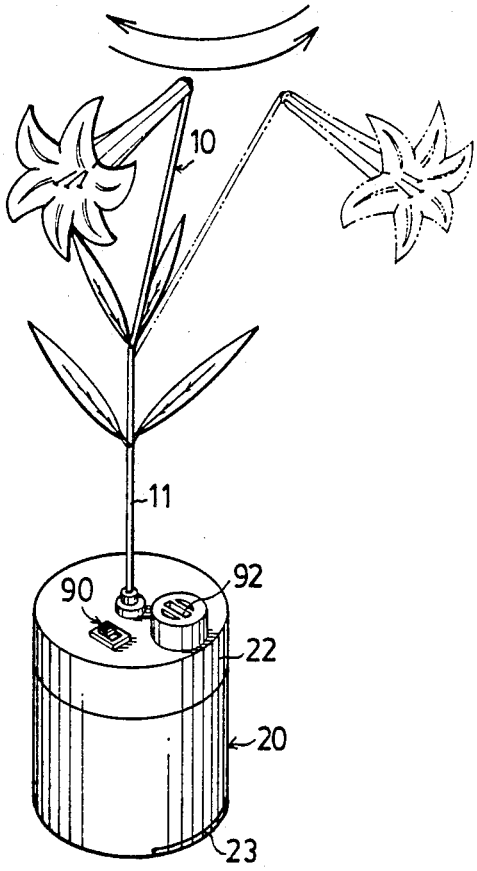
FIG. 1 is a perspective view of an electronic flower set in accordance with the present invention.
Figure 2:
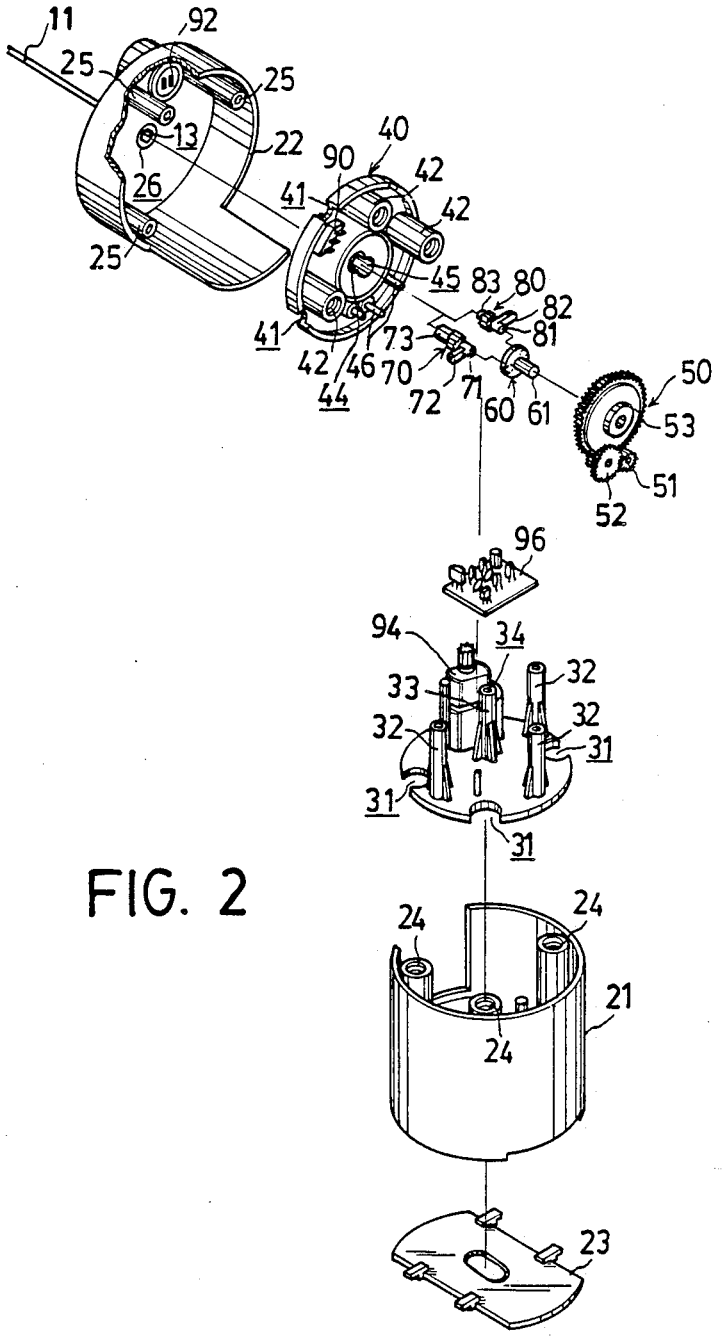
FIG. 2 is an exploded view of the electronic flower set shown in FIG. 1, excluding the ornamental portion itself.

Referring to the drawings and initially to FIGS. 1 and 2, it can be seen that an electronic flower set in accordance with the present invention comprises a flower set 10, a housing 20, an inner seat 30, an inner cover 40, a gear assembly 50, a matching plug 60, a first pinion 70, and a second pinion 80.

The flower set 10 includes a rotatable stem 11 provided with a head 12 with a hexagonal-shaped cavity 13. The rotatable axle 11 resembles the stalk of a flower.

The housing 20 includes a cylindrical main body 21. The cylindrical main body 21 is covered by an upper cover 22 and a lower cover 23 so as to form a room for retaining other elements. Battery replacement is carried out by removing the lower cover 23.

Although not limited thereto, it is preferable that the main body 21 has a plurality of upstanding tubes 24 formed at the periphery thereof while the upper cover 22 has a plurality of downwardly extending poles 25 formed at the periphery thereof which are engageable with the upstanding tubes 24 such that the main body 21 can be engaged with the upper cover 22 to form the assembled housing 20, as depicted in FIG. 1.

Referring back to FIG. 1, it can be seen that the upper cover 22 includes a hole 26 for receiving the rotatable stem 11 of the flower set 10. The upper cover 22 is further provided with a rectangular opening (not shown, as it is block by the sidewall of the upper cover 22) for retaining a switch 90 to control the on/off function of the electronic flower set. A microphone 92 is attached on an inner face of the upper cover 22 for receiving external sound signal. Once the switch 90 is turned on and a sound signal is detected, the flower set 10 starts moving intermittently from left to right or from right to left.

Referring again to FIG. 2, the internal structure of the electronic flower set can be understood. The inner seat 30 and the inner cover 40 is placed within the housing 10.

Although not limited thereto, it is preferable that the inner seat 30 includes a plurality of cutouts 31 which correspond to the location of the upstanding tubes 24 of the main body 21 of the housing 20 such that the inner seat 30 can be placed on the main body 21. The inner seat 30 is provided with a plurality of upstanding poles 32 at the upper periphery thereof.

The inner cover 40 includes a plurality of cutouts 41 which correspond to the location of the downwardly extending poles 25 of the upper cover 22 such that the inner cover 40 can be placed snugly against the upper cover 22. The inner cover 40 is further provided with a plurality of downwardly extending tubes 42 which correspond to the upstanding poles 32 of the inner seat 30 such that the inner seat 30 and the inner cover 40 are engageable.

The inner seat 30 is provided to retain a motor 94 and a sound control circuit board 96 which is connected with the switch 90 and the motor 94. The inner seat 30 is formed with an upstanding central tube 33 having a hole 34.

The inner cover 40 further includes a rectangular opening (not shown, as it is blocked by the switch 90) which is adapted to retain the switch 90. The rectangular opening of the inner cover 40 corresponds to the rectangular opening of the upper cover 22.

The inner cover 40 is formed with a perforation 44 at a central part and a retaining cavity 45 at the central part, with the perforation 44 and the retaining cavity 45 adjoining each other. The perforation 44 aligns with the hole 26 of the upper cover 22 so as to receive the rotatable axle 11 therein. The retaining cavity 45 is formed on the inner face of the inner cover 40.

The inner cover 40 further includes two pins 46 at the periphery thereof for fixing the gear assembly 50, which will be described more fully hereinbelow.

The gear assembly 50 includes a first gear 51 of small size, a second gear 52 of medium size, and a third gear 53 of large size. The third gear 53 is actuated by the motor 94 through the first gear 51 and the second gear 52, respectively. The first gear 51 and the second gear 52 are rotatably fixed by the pins 46 of the inner cover 40. The third gear 53 is formed in a uniform thickness and includes a circular recess 54 with a central hole 55. An inner wall of the third gear 53 is formed with a stopper 56 (see FIG. 4).

The matching plug 60 is adapted to be retained in the circular recess 54 of the third gear 53. The matching plug 60 includes a tube 61 on one side which is received in the central hole 55 of the third gear 53 and in the hole 34 of the central tube 33. The matching plug 60 includes two matching holes 62 on the other side for receiving the first pinion 70 and the second pinion 80.

The first pinion 70 includes an end tube 71 adaptable to be fixed in one of the matching holes 62 of the matching plug 60. The second pinion 80 includes an end tube 81 adaptable to be fixed in the remaining matching holes 62 of the matching plug 60. The two pinions 70 and 80 are meshed with each other after being fixed in the matching holes 62.

The first pinion 70 is provided with a sideward extending arm 72. The second pinion 80 is provided with a sideward extending arm 82. The arms 72 and 82 are provided to control the inter-related motion between the first and second pinions 70 and 80, which will be described more fully hereinbelow.

The structure of the first pinion 70 and the second pinion 80 are substantially the same. The only difference is that the first pinion 70 is formed with a hexagonal-shaped end tube 73 at the end part remote from the end tube 71 while the second pinion 80 is formed with a round-shaped end tube 83 at the end part remote from the end tube 81. The hexagonal-shaped end tube 73 is passable through the perforation 44 and is retained in the hexagonal-shaped cavity 13 of the head 12 of the rotatable stem 11. The round-shaped end tube 83 is adapted to be retained in the retaining cavity 45 of the inner cover 40.

Figure 3:
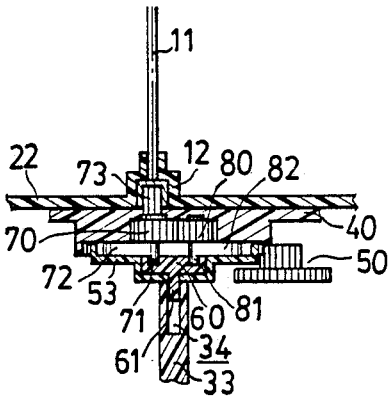
FIG. 3 is a fragmentary sectional view of the gear portion of the electronic flower set of FIG. 1.

After assembling the two pinions 70 and 80, the matching plug 60, and the gear assembly 50 with the inner seat 30 and after engaging the inner cover 40 and the inner seat 30, the gears mesh together as depicted in FIG. 3. The matching plug 60 and the two pinions 70 and 80 are placed within the circular recess 54 of the third gear 53 such that the rotating axle 11 is in communication with the first pinion 70 through the perforation 44, and the two pinions 70 and 80 mesh with each other. The sideward extending arms 72 and 82 can move freely on the surface of the third gear 53 and by pushing the sideward extending arm 72 of the first pinion 70, the rotating axle 11 will deflect and move the flower set 10.

Figure 4:
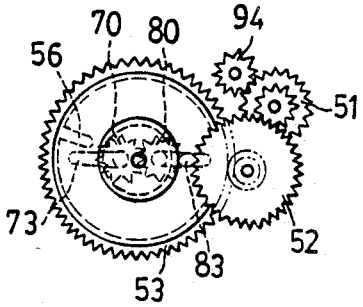
FIG. 4 is top view of the gear portion of the electronic flower set shown in FIG. 3.
Figure 5:
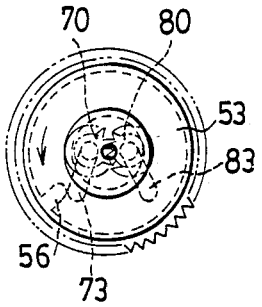
FIGS. 5–8 are views showing various stages in the movement of the gears and pinions of the electronic flower set.
Figure 6:
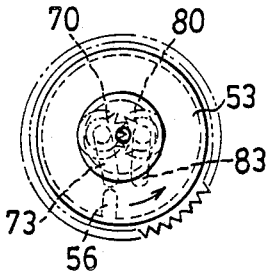
Figure 7:
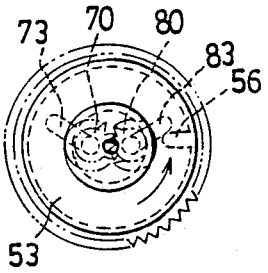
Figure 8:
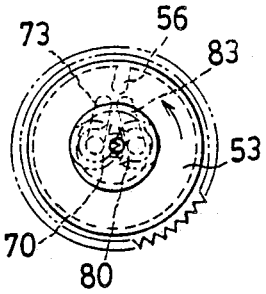

Referring to FIG. 4, it can be clearly seen that the surface of the third gear 53 is formed with the aforementioned stopper 56. When the third gear 53 is actuated to the state as shown in FIG. 5, the stopper 56 pushes the arm 72 of the first pinion 70 to move counterclockwise. The rotatable stem 11 together with the flower set 10, which is directly actuated by the first pinion 70 thus moves counterclockwise. Since the second pinion 80 is meshed with the first pinion 70, the second pinion 80 thus rotates clockwise. When the third gear 53 and the two pinions 70 and 80 are moved to the critical situation as shown in FIG. 6, the stopper 56 detaches from the arm 72 of the first pinion 70 and contacts the arm 82 of the second pinion 80. At this juncture, the stopper 56 starts pushing the arm 82 of the second pinion 80 to move counterclockwise, as depicted in FIG. 7. Since the first pinion 70 is meshed with the second pinion 80, the first pinion 70 thus rotates clockwise. The rotatable stem 11 together with the flower set 10 which is directly actuated by the first pinion 70, thus move clockwise. When the third gear 53 and the two pinions 70 and 80 are moved to the critical situation shown in FIG. 8, the stopper 56 detaches from the arm 82 of the second pinion 80 and contacts the arm 72 of the first pinion 70. The motion of the third gear 53 and the two pinions 70 and 80 thus repeats itself. Accordingly, the flower set 10 thus rotates periodically or intermittently from left to right and from right to left.

While the invention has been described in relation to its preferred embodiment, it is to be understood that numerous modifications, alterations and alternate embodiments may be contemplated by those skilled in the art upon reading this specification. It is envisioned that all such alternate embodiments are considered to be within the scope of the present invention as defined by the appended claims.

I claim:

1. An electronic flower set comprising:

a flower set 10 having a rotatable stem 11 provided with a head 12 with an hexagonal cavity 13;

a housing 20 including a cylindrical main body 21 and an upper cover 22 which is combinable to said main body 21, said upper cover 22 having a hole 26 for receiving said rotatable stem 11, said upper cover 22 being provided with a rectangular opening for retaining a switch 90, a microphone 92 being attached on an inner face of said upper cover 22;

an inner seat 30 being placed within said housing 20 for retaining a motor 94 and a sound control circuit board 96 which is connected with said switch 90, said microphone 92 and said motor 94, said inner seat 30 being formed with a central tube 33 having a hole 34;

an inner cover 40 being placed within said housing 20 snugly against said upper cover 22, said inner cover 40 including a rectangular opening for fixing said switch 90, a perforation 44 at a central part thereof and a retaining cavity 45 at a central part thereof, said perforation 44 and said retaining cavity 45 adjoining each other, said retaining cavity 45 being formed on an inner face of said inner cover 40; said perforation 44 being in alignment with said hole 26 for receiving said rotatable axle 11;

a gear assembly 50 including a first gear 51, a second gear 52, and a third gear 53, said third gear 53 being actuated by said motor 94 through said first gear 51 and said second gear 52; said third gear 53 being formed in an uniform thickness and includes a circular recess 54 with a central hole 55, a surface of said third gear 53 being formed with a stopper 56;

a matching plug 60 retained in the circular recess 54 of said third gear 53, said matching plug 60 including a tube 61 on one side which is received by said central hole 55 of said third gear 53 and by said hole 34, said matching plug 60 including two matching holes 62 on the other side;

a first pinion 70 including an end tube 71 fixable in one of the matching holes 62 of said matching plug 60, a sideward extending arm 72, and a hexagonal-shaped end tube 73 at the end remote from the end tube 71; said hexagonal-shaped end tube 73 being adaptable in the hexagonal-shaped cavity 13 of the head 12 through said perforation 44; and a second pinion 80 which is meshed with said first pinion 70, said second pinion 80 including an end tube 81 fixable in the remaining matching holes 62 of said matching plug 60, a sideward extending arm 82, a round-shaped end tube 83 at an end part remote from the end tube 81, said round-shaped end tube 83 being retainable in the retaining cavity 45 of said inner cover 40.

2. An electronic flower set as described in claim 1, wherein said cylindrical main body 21 is covered by a lower cover 23.

3. An electronic flower set as described in claim 1, wherein said main body 21 is formed with a plurality of upstanding tubes 24 at a periphery thereof.

4. An electronic flower set as described in claim 3, wherein said upper cover 22 is formed with a plurality of downwardly extending poles 25 at the periphery thereof which are engageable with the upstanding tubes 24.

5. An electronic flower set as described in claim 3, wherein said inner seat 30 includes a plurality of cutouts 31 which correspond to the location of the upstanding tubes 24.

6. An electronic flower set as described in claim 5, wherein said inner seat 30 is provided with a plurality of upstanding poles 32 at a periphery thereof.

7. An electronic flower set as described in claim 4, wherein said inner cover 40 includes a plurality of cutouts 41 which correspond to the location of the downwardly extending poles 25.

8. An electronic flower set as described in claim 6, wherein said inner cover 40 is further provided with a plurality of downwardly extending tubes 42 which correspond to the upstanding poles 32.

9. An electronic flower set as described in claim 1, wherein said inner cover 40 further includes two pins 46 at a periphery thereof.

10. An electronic flower set as described in claim 9, wherein said first gear 51 and said second gear 52 are fixed by the pins 46.

* * * * *